United States Patent [19]

Vodin

[11] Patent Number: 4,609,197

[45] Date of Patent: Sep. 2, 1986

[54] GOLF PRACTICE DEVICE

[76] Inventor: George M. Vodin, 452 Creekwood Dr., Palatine, Ill. 60067

[21] Appl. No.: 572,906

[22] Filed: Jan. 23, 1984

[51] Int. Cl.[4] ..... A63B 69/36

[52] U.S. Cl. ..... 273/184 B; 273/58 C; 273/200 R; 273/198

[58] Field of Search ..... 273/184 B, 185 C, 198, 273/200 R, 196, 197 R, 197 A

[56] References Cited

U.S. PATENT DOCUMENTS

| | | | |
|---|---|---|---|
| 1,399,293 | 12/1921 | Craig et al. | 273/200 R |
| 1,527,716 | 2/1925 | Tippen et al. | 273/198 |
| 2,656,720 | 10/1953 | Sonnett | 273/185 C |
| 3,031,889 | 5/1962 | Magazanik et al. | 273/200 R |
| 3,122,369 | 2/1964 | Windall | 273/185 C |
| 3,830,504 | 8/1974 | Koo | 273/185 C |
| 4,113,257 | 9/1978 | Moffatt | 273/200 R X |

*Primary Examiner*—George J. Marlo
*Attorney, Agent, or Firm*—John C. Brezina

[57] ABSTRACT

The improved golf practice device disclosed herein is designed to permit golfers to practice their golf swings in a relative restricted area and to give them an indication, the power of their swings, by means of an impact measuring device attached and secured to the upper end of a rigid, hollow stake driven into the ground. A shock cord is attached at one end at the bottom of the stake and the other end is attached by appropriate means to the golf ball mounted on the top of the stake. The measuring indicator comprises a flat bar member having a central longitudinally extending slot in which is disposed a helical spring member having one of its ends secured to a plunger slideably moveable in said slot and the other end of said spring member being secured to the flat member. A cord has one end around extending through the helical member and secured to said plunger and the other end of said cord passes through a passage communicating with the interior of said stake thereby permitting the other end of the cord to be attached to the shock cord, a predetermined distance below the mounted golf ball. The slot also slideably supports an indicator slide which is adapted to be moving by the plunger which will move the indicator slide a measured distance along the flat bar whenever the golf ball is struck by a gold club head.

18 Claims, 10 Drawing Figures

FIG. 1
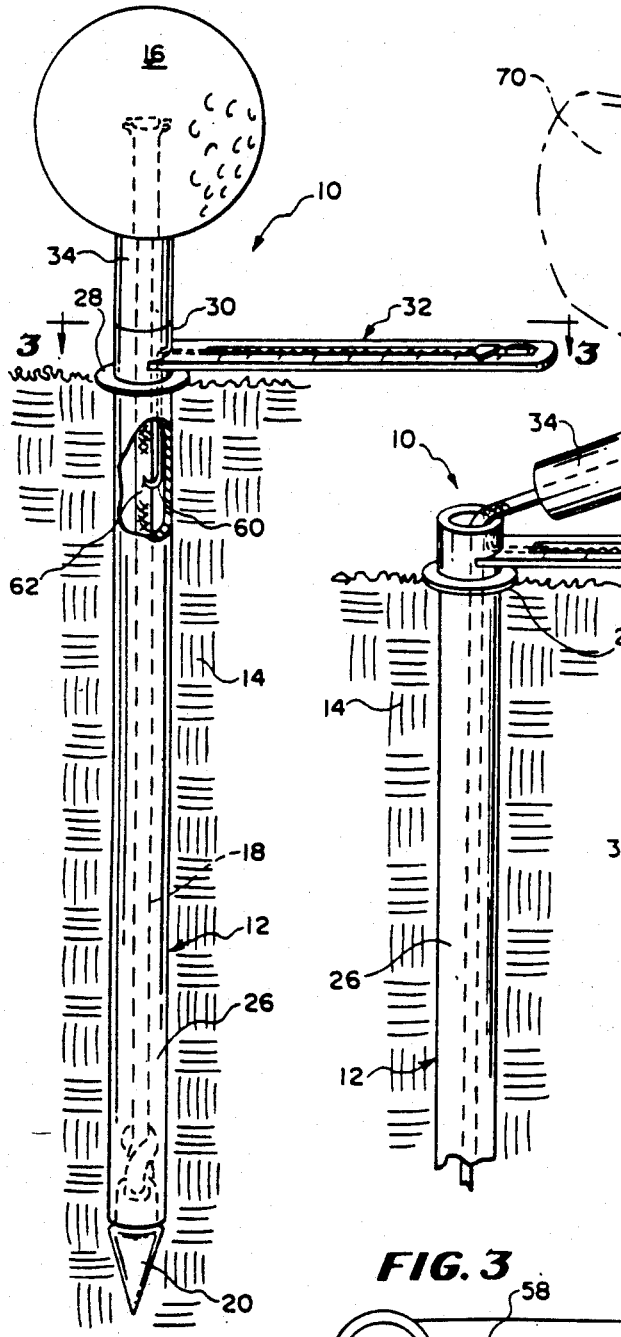
FIG. 2
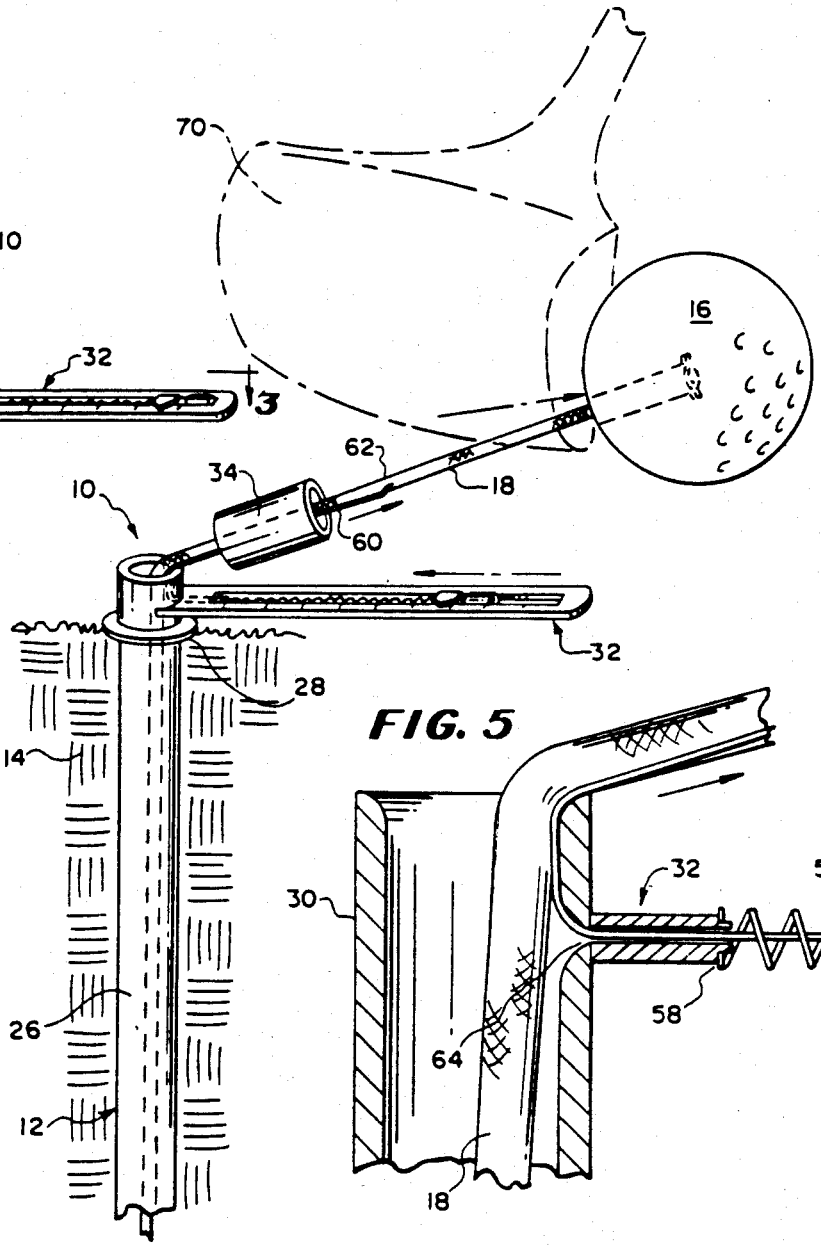
FIG. 5
FIG. 3
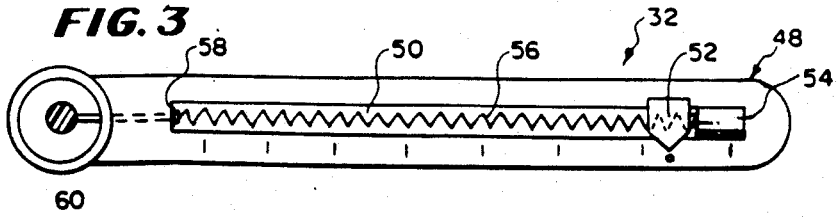
FIG. 4
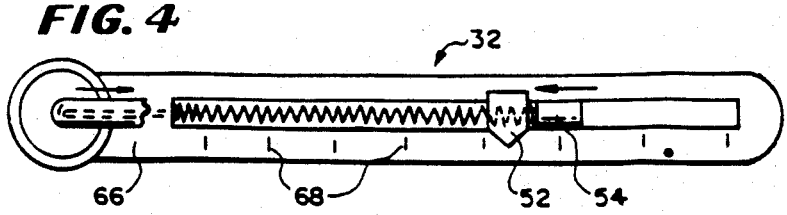

FIG. 6
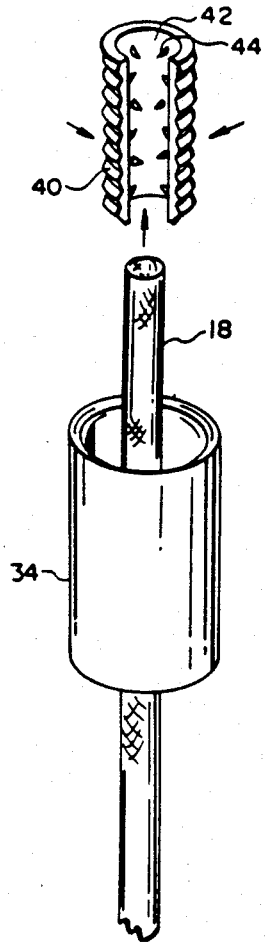
FIG. 7
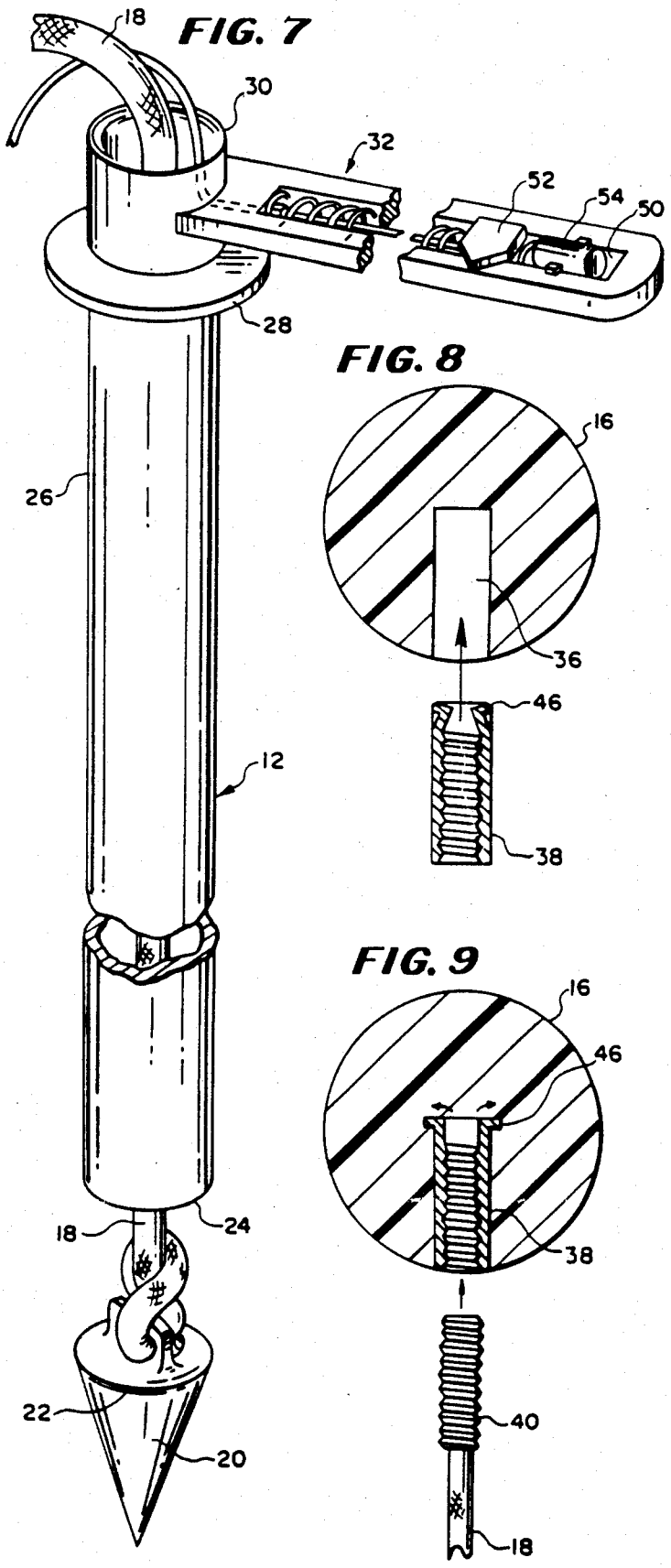
FIG. 8
FIG. 9

GOLF PRACTICE DEVICE

BACKGROUND OF THE INVENTION

The present invention relates, generally, to a device for permitting golfers to practice their golf swing and at the same time measure the impact velocity as it would relate to distance, while at the same time giving him a measured indication of the relative distance the ball would have travelled if it were free.

Previously, many devices have been developed for permitting golfers to practice the hitting of the golf ball which is tethered by a form of a linkage secured to a ground stake or similar structure. For example, an example of known devices using a golf ball tethered to a ground stake is described in U.S. Pat. No. 4,095,798. Another form of a golf practice device using a golf ball secured to a base supported on a stake driven into the ground is described in U.S. Pat. No. 3,981,508. One of the disadvantages of these known practice devices is they are not provided with any means for relatively measuring the distance of the ball after it is hit to give the golfer an indication of how well the ball was hit by a club. Another disadvantage of the known devices lies in the manner of securing the golf ball to the anchor. In all these devices, the ball is secured by a linkage which permits the ball to rotate about the anchor after the ball is hit. Such an arrangement does not permit the golf ball to travel in a straight line as directed by the club head impact. In other words, as soon as the ball supported by the known device is hit, it begins to deviate away from the direction of the club head impact. Another disadvantage of these devices is that if your swing is outside of the impact area your club head may hit the core of the device and be damaged. In other embodiments that ball is connected to a long cord (tether) which could whiplash after impact and must be manually retrieved after such impact.

SUMMARY

To overcome the foregoing disadvantages of the known golf practice devices, the present invention provides a golf practice device using a measuring or distance indicator which is secured to a hollow stake driven into the ground, the indicator being supported near the top of the stake which supports a golf ball coupled to a shock cord passing through the hollow stake and secured at the bottom by a cleat or other affixment means. The indicator is linked to the shock cord by a filament which passes through a port on the stake and attaches on the interior of the stake. Upon impact, the golf ball travels a short distance along the path of the golf club swing stretching the shock cord and the filament connected to the indicator, thereby giving a relative indication of how far the golf ball was struck. After elongation, the shock cord contracts in a straight line bringing the golf ball back to rest at its original position atop of a rubber extension which prevents damage to the ball on retraction and fraying to the cord upon impact from the club.

The main object of the invention is to provide a golf ball practice device which gives an indication of the relative distance the golf ball would travel after being hit.

Other details, uses, and advantages of this invention will become apparent as the following description of the preferred embodiment is presented in the accompanying drawings.

BRIEF DESCRIPTION OF THE DRAWING

The accompanying drawing illustrates a preferred embodiment of this invention, in which:

FIG. 1 is a perspective view of an improved golf practice device of the present invention shown secured to a ground surface;

FIG. 2 is a perspective view of the golf practice device in use at the time a golf ball supported by the device is struck by a golf club head;

FIG. 3 is an enlarged top view of a distance indicator in a normal position with the free sliding indicator set on zero;

FIG. 4 is an enlarged top view of the indicator device having the indicator slide showing the relative distance the ball has moved from its anchored position;

FIG. 5 is a partial enlarged sectional view showing the relationship between the shock cord and the coupling between the indicator device and the shock cord;

FIG. 6 is an enlarged perspective view of a male connector which cleats to the cord when compacted and forms an attachment means to the ball and also the rubber extension which acts as a tee, protects the cord from fraying and buffers the shock as the ball is being returned to its original position by contraction of the cord.

FIG. 7 is an enlarged perspective view of the golf practice device;

FIG. 8 is a sectional view of a golf ball adapted with a female connector inserted to be used with the present device; and FIG. 9 is a perspective view of the golf ball and its adapted securement to the shock cord.

DESCRIPTION OF THE PREFERRED EMBODIMENT

Figure 10:
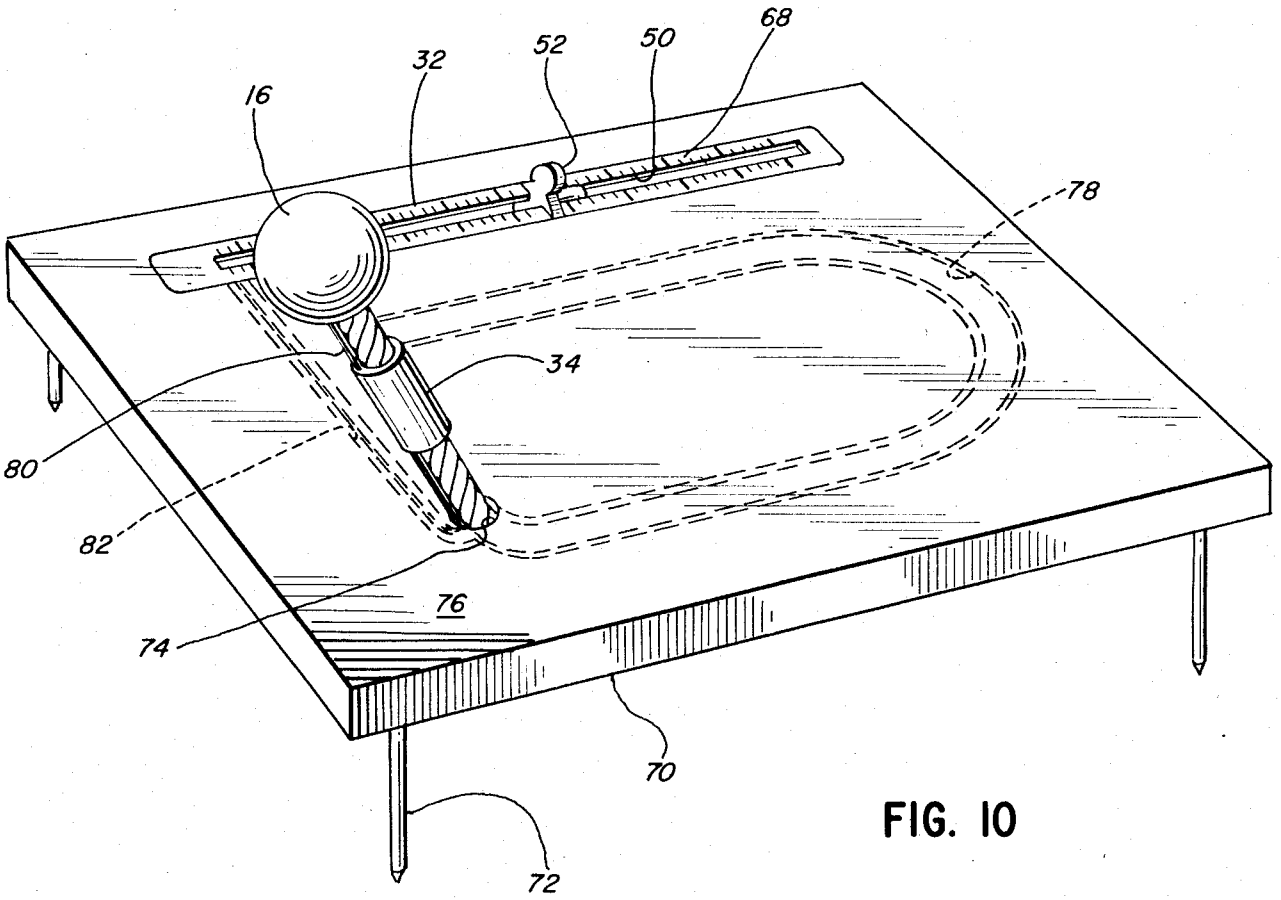
FIG. 10 is a pespective view of a modified version wherein the golf ball and the support elements are held by a horizontal plate-like member adapted to be affixed to the ground.

The preferred embodiment of the golf practice device (10) is best illustrated in the pictorial representations of FIGS. 1 and 2, wherein a hollow stake (12) is driven into ground (14) and at its upper end supports a golf ball (16) secured to one end of a shock cord (18), the other end of the shock cord being secured to a conical point (20) provided with a chamfered seat (22), (FIG. 7), adapted to internally engage at the lower end (24) of the stake (12). The stake (12) comprises a shank (26), a base (28), and a collar (30) which supports a measuring indicator (32). The base (28) is secured by appropriate means such as welding to the stake (12) and functions as a means for enabling the golfer to drive the stake into the ground (14). The golf ball (16) is supported by means of a spacer (34) on the top of the collar (30).

As shown in FIGS. 8 and 9, the golf ball (16) is provided with a round opening (36) adapted to receive a female sleeve (38) adding an interior provided with threading which, in turn, are adapted to receive a male compression sleeve (40) secured to an end of the shock cord (18). The compression sleeve (40), as shown in FIG. 6, has an internal surface (42) provided with spikes (44) which will bite into the shock cord (18) when the sleeve (40) is compressed to the shock cord. The compression sleeve (40) is provided with external threading engageable with the interior of the threading of the sleeve (38). As illustrated in FIG. 8, the sleeve (38) is provided with a shoulder (46) which has been depressed inwardly to assume the diameter of the sleeve. After the sleeve (38) is inserted into the golf ball (16), as shown in FIG. 9, the innermost end of the sleeve (38) is expanded by an appropriate tool so that the shoulder (46) is embedded in the interior of the golf ball (16).

The measuring indicator (32), as particularly shown in Figures 3 and 4, comprises a flat bar (48) provided with a centrally elongated opening (50) which defines a bed for slideably supporting an indicator slide (52) which is adapted to be moved by a plunger (54) positioned within the opening (50) and attached to a helical spring (56) secured to and abutting a wall (58) at one end of the slot (50). The plunger (54) is also secured to a cord (60) which passes through the interior of the helical spring (56) and has its other end secured to the shock cord (18) at a point (62) in the region below the base (28), as best shown in FIG. 1. The measuring indicator (32) is appropriately secured to the collar (30), such as by welding, the flat bar (48) at the point of securement to the collar (30) being provided with an opening (64) which provides a passage for the cord (60).

A top surface (66) of the flat bar (48) is provided with indicia marks (68) to give positional indication of the movement of the indicator slide (52).

FIG. 10 shows a modified version 78 which makes use of a base member or anchor plate 71 in place of the stake 12. The anchor plate 71 is secured to the ground by anchoring means or spikes 72.

The ball 16 is supported on the anchor plate 71 by spacer 34. The ball 16 is attached to the end of shock cord 18 which which extends from the ball 16 through the spacer 34, into opening 70 in the top surface 76 of anchor plate 71, and through passageway 74, which curves to provide room for a substantial length of the shock cord 18 within the spatial confines of the anchor plate 71. The end of the shock cord 18 opposite the end attached to the ball 16 is attached to the anchor plate 71 at the inner end of the passageway 74. The ball 16 is drawn resiliently by cord 18 into a position of support on the spacer 34 and above opening 70.

A measuring indicator 32 is provided on the anchor 71 and is similar to that described above, having an opening 50 which defines a bed for slideably supporting an indicator slide 52. The slide 52 is connected with connection member or indicator cord 80 which extends through a second passageway 82, through opening 70, through spacer 34, and is attached to the ball 16.

USE OF THE GOLF PRACTICE DEVICE

As previously described, the stake (12) is driven into ground by applying a downward force to the base (28), until the base abutts the ground (14), as shown in FIG. 1. At this time, the measuring indicator (32), as shown in FIG. 3, will have its slide (52) positioned adjacent to the zero setting. When the golf ball (16) is struck by a club head (70), the golf ball (16) will move upwardly and in a direction parallel to the flat bar (48). Because of the impact, the golf ball (16) will stretch the shock cord (18) a predetermined distance, at the same time pulling on the cord (60) which will move the plunger and, in turn, will compress the spring (56) in the direction shown by the arrowhead in FIG. 4 to thereby move the indicator slide (52) which will point to one of the indicator marks (68) to give the golfer an idea of how far the ball would have travelled in free flight. Although the stake (12), as shown in FIG. 7, is provided with a conical point (20), it is apparent that other means may be used for preparing the stake (12) to be driven into the ground. For example, the lower end of the stake (12) can be formed to have a conical entry point integral with the stake, and the lower end of the stake would be provided with other means for securing the lower end of the shock cord to the lower end of the stake (12).

The modified version shown in FIG. 10 operates in a manner similar to that described above. When the golf ball 16 is struck, it moves upwardly and away from the opening 70 over which it was at rest. This stretches the shock cord 18 over its length in the passageway 74. The expansion of the shock cord 18 pulls on the indicator cord 80 which in turn moves the indictor slide 52 to point to one of the indicator marks 68, giving an estimate of the distance that the ball would have travelled in free flight.

While the present embodiment of this invention has been illustrated and described in particular, it should be recognized that this invention may be otherwise variously embodied and practiced within the scope of the following claims.

In accordance with my invention, I claim:

1. A golf practice device, comprising:

a golf ball, an anchoring member having a passageway therein, and supporting the golf ball thereon, a resilient cord being attached to said golf ball and extending into the passageway and being connected to the anchoring member within said passageway, for resiliently securing and mounting said golf ball to the top of said anchoring member, the resilience of the cord allowing the ball multi-directional movement away from the passageway, an impact measuring device secured to said anchoring member, connection cord means connected with said impact measuring device and extending into said passageway and being connected with said resilient cord at a location spaced below the upper end of said anchoring member therein.

2. The device according to claim 1, wherein said anchoring member comprises a hollow, ground-penetrating, rigid stake.

3. The device according to claim 2, said cord having a compression sleeve provided with external threading and crimped to the end of said cord, said golf ball being provided with an opening extending toward the center of said golf ball, and a female sleeve, internally threaded, and conformably received in said opening, whereby said cord is connected to said golf ball by screwing in the compression sleeve into the female sleeve.

4. The device according to claim 1, said impact measuring device comprising an elongated member provided with an elongated slot, a resilient member disposed in the length of said slot, a plunger slideably disposed in said slot at the distal end of said elongated member, one end of said resilient member being secured to said plunger and the other end being secured to the elongated member at the other end of said slot, an indicator slide disposed in said slot and said cord means passing through said resilient member and attached to said plunger, a passage extending from one end of said slot and communicating with the passageway in said anchoring member, the other portion of said cord means passing through said passage and secured to said cord in the passageway in said anchoring member.

5. The device according to claim 1, including a spacer slideably mounted on said cord between said golf ball and said anchoring member.

6. The invention according to claim 5, the spacer being a ball tee made of resilient material for absorbing the shock of impact of a golf club.

7. The device according to claim 2, including a pointed portion mounted at a lower end of said ground penetrating hollow anchoring member to facilitate the entry of said anchoring member into ground.

8. A golf practice device comprising:

a hollow stake extending substantially vertically and supporting a golf ball to be hit thereon;

an expandable elastic cord extending within the hollow stake, one end of the cord being attached to the lower end of the stake;

the golf ball being attached to the other end of the cord and being elastically drawn by the cord into a position of support above the stake;

a connection member attached within the stake intermediate the ends thereof to the cord;

ball flight distance instrumentation projecting transversely from the stake and comprising:

a housing connected with the stake and having measuring indicia on the instrumentation;

indicator means movably supported in the housing and connected with the connection member for movement therewith and cooperative with the mesuring indicia to show the distance the ball would have traveled in free flight; and biasing means in said housing being operatively connected with the connection member and with the indicator means, said biasing means urging the indicator means in a direction outwardly of the stake, said biasing being compressed upon impacting of the golf ball, whereby when the golf ball is hit, the extent of stretch imparted to the cord is transmitted via the connection member to the indicator means to provide an indication of the distance which the golf ball would have travelled were it not attached to the cord.

9. The invention according to claim 8, and the lower end of the stake including a pointed portion whereby the stake is driven into the ground.

10. The invention according to claim 8, and a spacer being slideably mounted on the cord between the golf ball and the stake and providing a seat for the golf ball when the golf ball is supported over the stake and the seat preventing damage to the golf practice device when the golf ball is hit.

11. The invention according to claim 8, and means for attaching the golf ball to the cord, said means comprising:

a first sleeve being provided with external securement means and being attached to the end of the cord;

the golf ball being provided with an opening extending toward the center of the golf ball; and a second sleeve conformably received in the opening in the golf ball, the second sleeve having securing means being connected with the securement means for securing the first sleeve in the second sleeve.

12. The invention according to claim 8 and the stake being in the ground; and the ball flight distance instrumentation extending adjacent ground level and being viewable by a golfer using the practice device.

13. The invention according to claim 8 and said connection member and cord being housed in the housing and the stake for protection from impact directed at the golf ball.

14. The invention according to claim 8 and the golf ball being supported on the stake above the connection of the connection member with the cord.

15. A golf practice device comprising:

an anchoring member having a passageway therein and being adapted to be anchored to the ground;

a golf ball supported on the anchoring member for being hit by a golf club;

an expandable elastic cord having one end attached to the golf ball and extending within the passageway, the other end of the cord being attached to the anchoring member within the passageway, whereby the golf ball is resiliently drawn by the cord into a position of support on the anchoring member; and means for attaching the golf ball to the cord, said means comprising:

a first sleeve being provided with external securement means and being attached to the end of the cord;

the golf ball being provided with an opening extending toward the center of the golf ball and terminating therein; and a second sleeve adapted to be received in the opening in the golf ball, the second sleeve having internal securing means detachably engageable with said external securement means for detachably securing the first sleeve in the second sleeve;

said second sleeve having shoulder means for securing said second sleeve in said opening whereby said golf ball has a realistic appearance when attached to said cord and said golf ball may be readily replaced by disengaging the first and second sleeves.

16. The invention according to claim 13, and an impact measuring device operatively associated with the golf ball for registering the magnitude of the impact of a golf club on the golf ball.

17. The invention according to claim 15, and the anchoring member comprising a plate shaped member and the passageway being within the plate-shaped member and substantially U-shaped.

18. The invention according to claim 15, and a spacer slideably mounted on the cord between the golf ball and the anchoring member.

* * * * *